US009834401B2

(12) United States Patent
Johnson et al.

(10) Patent No.: US 9,834,401 B2
(45) **Date of Patent: *Dec. 5, 2017**

(54) TAPE DISPENSER

(71) Applicant: WAGIC, INC., San Jose, CA (US)

(72) Inventors: Kenneth R. Johnson, Campbell, CA (US); Yugen Patrick Lockhart, Palo Alto, CA (US); Steven Simas Escobar, San Jose, CA (US)

(73) Assignee: Wagic, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/174,832

(22) Filed: Jun. 6, 2016

(65) Prior Publication Data

US 2016/0280498 A1 Sep. 29, 2016

Related U.S. Application Data

(63) Continuation of application No. 14/806,152, filed on Jul. 22, 2015, now Pat. No. 9,382,092, which is a continuation of application No. 13/253,902, filed on Oct. 5, 2011, now Pat. No. 9,120,638.

(51) Int. Cl.

| | |
|---|---|
| ***B44C 7/00*** | (2006.01) |
| ***B65H 35/00*** | (2006.01) |
| ***B65H 35/10*** | (2006.01) |
| ***B65H 35/06*** | (2006.01) |

(52) U.S. Cl.

CPC ..... *B65H 35/0026* (2013.01); *B65H 35/06* (2013.01); *B65H 35/0006* (2013.01); *B65H 35/0033* (2013.01); *Y10T 156/1052* (2015.01); *Y10T 156/12* (2015.01); *Y10T 156/1348* (2015.01); *Y10T 156/1795* (2015.01); *Y10T 225/10* (2015.04); *Y10T 225/26* (2015.04)

(58) Field of Classification Search

CPC ..... B65H 35/002; B65H 35/0033; B65H 35/0026; B65H 37/005; B65H 37/007; B65H 35/00; B65H 35/07; B65H 35/008; B65H 35/006; B65H 3701/31; B65H 37/00; B65D 85/672; B65D 85/671; B65D 85/02; B65D 1/02; Y10T 156/1348; Y10T 156/1795; B65F 3/02; B65F 1/32

USPC ..... 225/60, 57, 82, 88, 66, 71, 67, 69, 656, 225/56, 61, 77, 6, 39, 26, 25, 19; 156/250, 577, 574

See application file for complete search history.

(56) References Cited

U.S. PATENT DOCUMENTS 1,606,774 A * 11/1926 Nelson ..... B65H 35/008 225/33
2,447,518 A * 8/1948 Marinski ..... B65H 35/0026 225/22
3,283,977 A * 11/1966 Schluchter ..... B65H 35/008 225/65

(Continued)

*Primary Examiner* — Alex Efta
(74) *Attorney, Agent, or Firm* — Haverstock & Owens LLP

(57) ABSTRACT

A tape dispenser includes a first arm, a second arm, a holder, a roller, a retaining device, a blade, spring(s) and one or more guides. The tape dispenser is positioned on a tape roll by positioning the holder on the inside of the tape roll and positioning the roller and retaining device on the outside of the tape roll. Tape is able to be pulled through the tape dispenser and then cut using the blade. After the tape is cut, the tape on the roll remains on the retaining device for easy access. The tape dispenser is also removable for use with many tape rolls.

22 Claims, 9 Drawing Sheets

(56) References Cited

U.S. PATENT DOCUMENTS

| | | | | |
|---|---|---|---|---|
| 4,405,068 | A * | 9/1983 | Blair | B65H 35/0026 225/65 |
| D290,139 | S | 6/1987 | Harris | |
| 4,711,384 | A | 12/1987 | Harris | |
| 4,957,234 | A * | 9/1990 | Orlandini | B65H 35/008 225/56 |
| D372,050 | S | 7/1996 | Ho | |
| D521,070 | S | 5/2006 | Hill | |
| D533,905 | S | 12/2006 | Gullicks et al. | |
| D568,400 | S | 5/2008 | Packard et al. | |
| D573,645 | S | 7/2008 | Sommers et al. | |
| D588,646 | S | 3/2009 | Vulpitta | |
| 7,841,498 | B1 * | 11/2010 | Rohrer | B65H 35/0026 225/56 |
| D646,330 | S | 10/2011 | Chen | |
| D649,191 | S | 11/2011 | Warner | |
| 9,120,638 | B2 * | 9/2015 | Johnson | B65H 35/0026 |
| 9,382,092 | B2 * | 7/2016 | Johnson | B65H 35/0026 |
| 2009/0302084 | A1 | 12/2009 | Liu | |
| 2010/0193539 | A1 * | 8/2010 | Fathi | B65H 35/0026 221/45 |

* cited by examiner

TAPE DISPENSER

RELATED APPLICATION(S):

The present application is a continuation of co-pending U.S. patent application Ser. No. 14/806,152, filed Jul. 22, 2015, and entitled "TAPE DISPENSER" which is a continuation of U.S. patent application Ser. No. 13/253,902, filed Oct. 5, 2011, and entitled "TAPE DISPENSER", now U.S. Pat. No. 9,120,638, which are all hereby incorporated by reference.

FIELD OF THE INVENTION

The present invention relates to hand tools. More specifically, the present invention relates to a tape dispenser.

BACKGROUND OF THE INVENTION

Adhesive tape dispensers are available in various models. In general, they are most widely known in the form of desk dispensers and hand-held dispensers requiring the use of two hands, whereby the tape roll is stored on a revolving spindle and are able to be cut at the desired length by a blade. Typically, tape dispensers are made up of a considerable number of components and are relatively large. For many devices, changing rolls of tape is often a complicated task.

SUMMARY OF THE INVENTION

A tape dispenser includes a first arm, a second arm, a holder, a roller, a retaining device, a blade, spring(s) and one or more guides. The tape dispenser is positioned on a tape roll by positioning the holder on the inside of the tape roll and positioning the roller and retaining device on the outside of the tape roll. Tape is able to be pulled through the tape dispenser and then cut using the blade. After the tape is cut, the tape on the roll remains on the retaining device for easy access. As the tape is removed and the tape roll gets smaller, the tension of the tape dispenser on the inside of the tape roll and the outside of the tape roll keeps the tape dispenser in place and allows it to function. The tape dispenser is also removable for use with many tape rolls.

In one aspect, a tape dispensing device comprises a first element, a second element, a roller coupled between the first element and the second element, the roller configured for applying a first force against an outer surface of a tape roll, a holder prong protruding from one of the first element and the second element, the holder prong configured for applying a second force against an inner surface of the tape roll, a retaining area coupled to an opposite element of the first element and the second element of the holder prong, the retaining area configured for retaining a tape end of the tape roll and a cutting device on the retaining area, the cutting device configured for cutting tape off the tape roll. The device further comprises a spring configured for biasing the roller against the tape roll. The roller is configured to roll or ride along the tape roll. The cutting device is coupled to the retaining area. The tape is selected from the group consisting of masking tape, duct tape, scotch tape, packing tape, silicone tape, electrical tape, reinforcing tape, protection tape, marking tape and double sided tape. The device comprises metal, plastic, polymers, rubber or any combination thereof.

In another aspect, a tape dispensing device comprises a first element, a second element, a roller coupled between the first element and the second element, the roller configured for applying a first force against an outer surface of a tape roll, a holder prong protruding from one of the first element and the second element, the holder prong configured for applying a second force against an inner surface of the tape roll, a retaining area coupled to an opposite element of the first element and the second element of the holder prong, the retaining area configured for retaining a tape end of the tape roll, a cutting device on the retaining area, the cutting device configured for cutting tape off the tape roll and a spring within the roller, the spring configured for biasing the roller against the tape roll. The roller is configured to roll or ride along the tape roll. The cutting device is coupled to the retaining area. The tape is selected from the group consisting of masking tape, duct tape, scotch™ tape, packing tape, silicone tape, electrical and vinyl tapes, reinforcing (Fiber) tape, protection tape, security tape, foam tape, urethane tape, marking tape and double sided tape. The device comprises metal, plastic, polymers, rubber or any combination thereof.

In another aspect, a method of utilizing a tape dispenser comprises installing the tape dispenser on a tape roll, including positioning a holder prong on the inside of the tape roll and positioning a roller on the outside of the tape roll, pulling tape through the tape dispenser and tearing the tape using a cutting device of the tape dispenser. The tape dispenser is pulled through the holder prong and the roller. The method further comprises removing the tape dispenser from the tape roll. Removing the tape dispenser from the tape roll includes lifting either a first element or a second element, and a retaining device are lifted up and away from the tape roll. The tape dispenser further comprises a spring configured for biasing the roller against the tape roll. The roller is configured to roll while the tape is pulled from the tape dispenser. The tape remains on a retaining area after tearing the tape. The cutting device is coupled to the retaining area. The tape is selected from the group consisting of masking tape, duct tape, scotch™ tape, packing tape, silicone tape, electrical and vinyl tapes, reinforcing (Fiber) tape, protection tape, security tape, foam tape, urethane tape, marking tape and double sided tape. The tape dispenser comprises metal, plastic, polymers, rubber or any combination thereof.

DETAILED DESCRIPTION

A tape dispenser enables a user to dispense tape, cut the tape as well as maintain the remaining tape so that the tape is more easily accessed.

Figure 1:
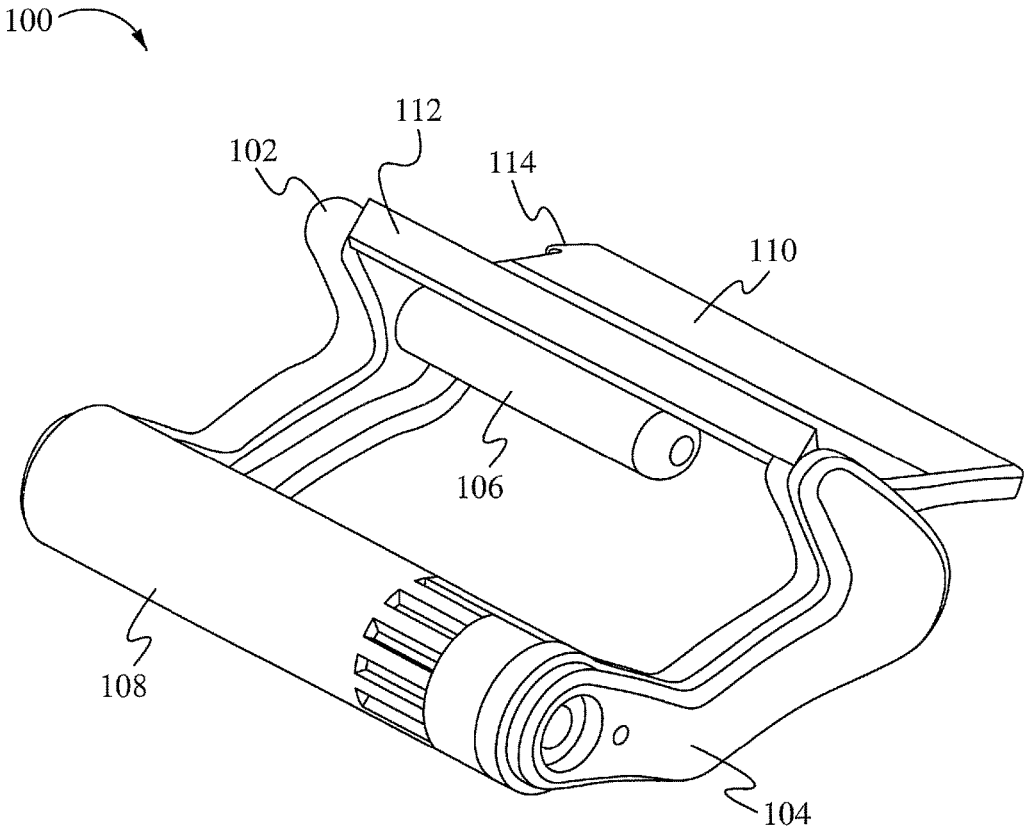
FIG. 1 illustrates a perspective view of a tape dispenser according to some embodiments.

FIG. 1 illustrates a perspective view of a tape dispenser 100 according to some embodiments. The tape dispenser 100 includes a first arm 102, a second arm 104, a holder 106, a roller 108, a retaining device 110, a blade 112 and one or more guides 114. In some embodiments, one or more springs 120 (FIG. 2) are included within the roller 108 and/or the first arm 102 and the second arm 104.

In some embodiments, an end of each of the first arm 102 and the second arm 104 is coupled to opposing ends of the roller 108. In some embodiments, the roller 108 is coupled to either the first arm 102 or the second arm 104. In some embodiments, the opposite end of the first arm 102 and the second arm 104 is coupled to opposing sides of the retaining device 110. In some embodiments, the retaining device 110 is coupled to the first arm 102 or the second arm 104. The retaining device 110 includes one or more guides 114 at one end. In some embodiments, the blade 112 is coupled to or extends from the retaining device 110. The blade 112 is coupled to or extends from the end opposite the guide(s) 114, and in some embodiments, the blade 112 is coupled to or extends from the same end of the guide(s) 114. A holder 106 such as a holder protrusion, pin or prong extends out or is coupled to either the first arm 102 or the second arm 104, whichever does not have the retaining device 110.

The tape dispenser 100 is configured to sit partially on top of a tape roll while also being detachably secured to the roll. The first arm 102 and the second arm 104 are configured to fit snugly around the tape roll. The holder 106 is configured to fit within the opening of a tape roll and then rest and apply a force against the inner ring of the tape roll. The roller 108 is configured to apply a force against the outer surface of the tape roll with the ability to easily roll along the surface of the tape roll. In some embodiments, the roller 108 does not roll and is able to slide or ride on the surface of the tape roll. The retaining device 110 is configured to rest on the outer surface of the tape. The retaining device 110 is also configured to receive and retain the tape so that the tape is easily accessible the next time a user needs the tape. The retaining device 110 also includes one or more guides 114 which are configured to guide the retaining device 110 on the roll of tape. The blade 112 coupled to or extending from the retaining device 110 is configured to cut or facilitate tearing of the tape. The tape dispenser 100 is sized to fit a specified roll of tape.

Figure 2:
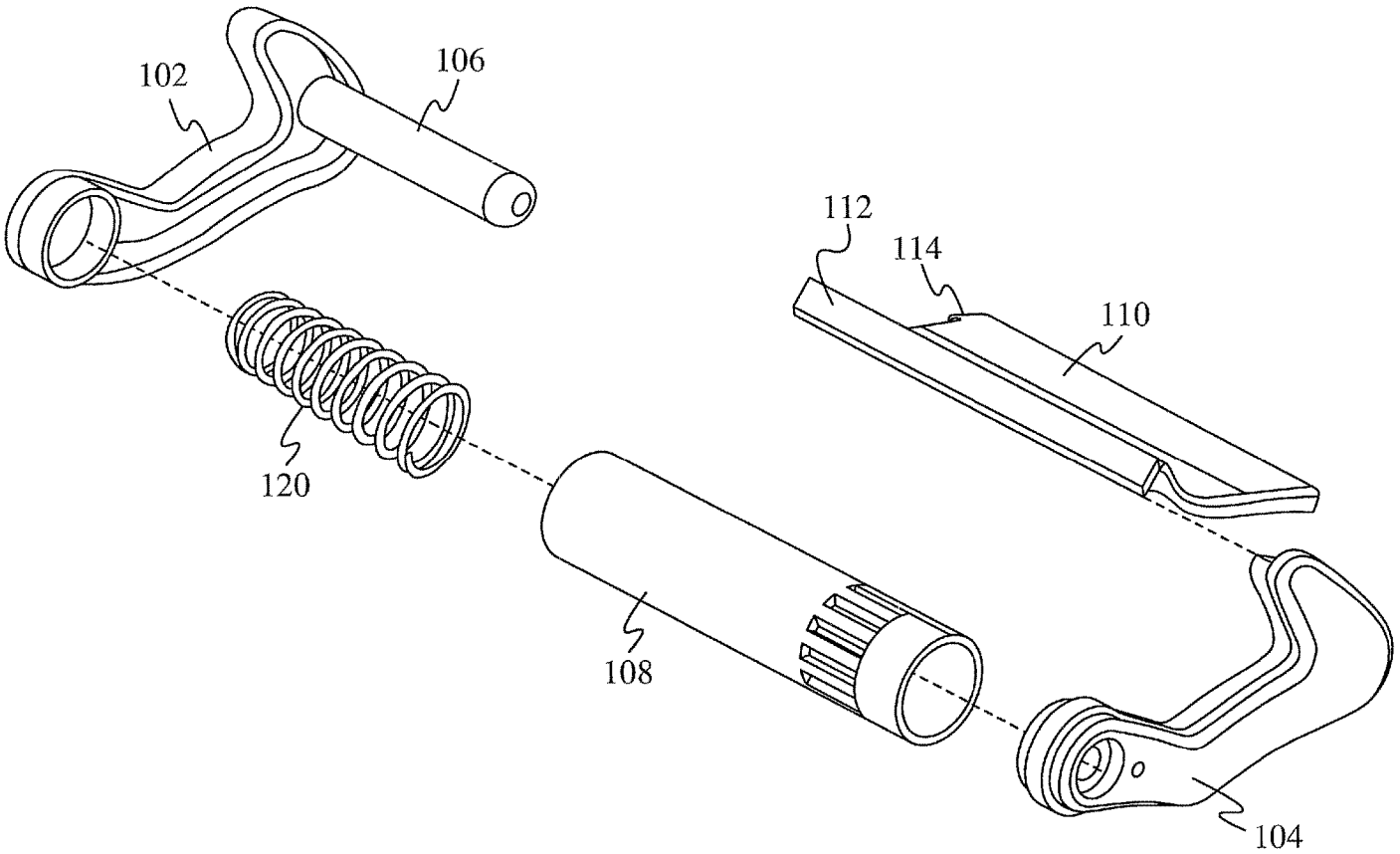
FIG. 2 illustrates the components of the tape dispenser according to some embodiments.

FIG. 2 illustrates the components of the tape dispenser 100 according to some embodiments. As described above, the tape dispenser 100 includes a first arm 102, a second arm 104, a holder 106, a roller 108, a retaining device 110, a blade 112 and one or more guides 114. In some embodiments, one or more springs 120 are included within the roller 108 and/or the first arm 102 and the second arm 104. In some embodiments, the spring(s) 120 apply an additional force on the roller 108 so that the tape dispenser 100 is more firmly secured on the tape roll. In some embodiments, the spring(s) 120 apply an additional force elsewhere. In some embodiments, the spring(s) 120 are configured to bias the roller 108 against the tape roll through a variety of tape roll thicknesses. In some embodiments, the spring(s) 120 are located in other components of the tape dispenser 100. In some embodiments, the first arm 102 and the roller 108 are a single piece. In some embodiments, the second arm 104 and the retaining device 110 are a single piece. In some embodiments, the first arm 102 and part or all of the roller 108 are a single piece. In some embodiments, the second arm 104 and part or all of the roller 108 are a single piece. In some embodiments, the roller 108 is multiple pieces.

Figure 3:
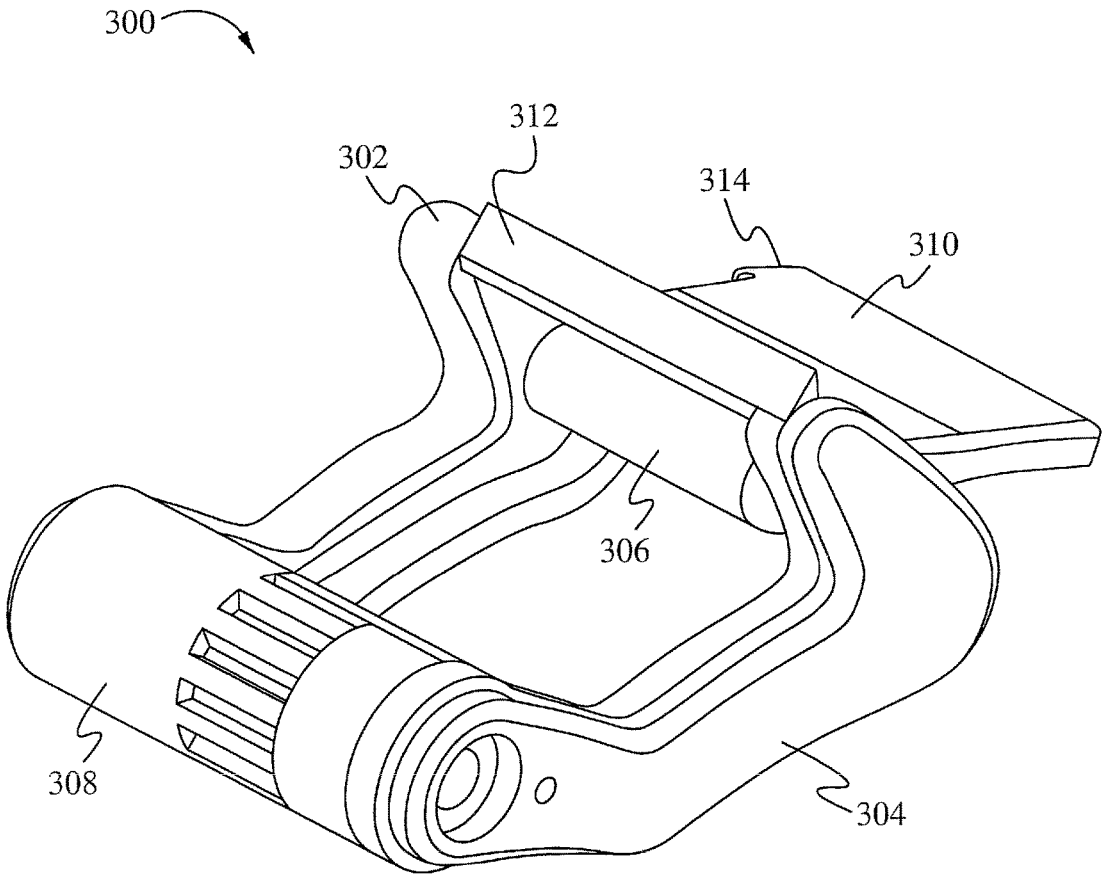
FIG. 3 illustrates a perspective view of a tape dispenser according to some embodiments.

FIG. 3 illustrates a perspective view of a tape dispenser 300 according to some embodiments. The tape dispenser 300 is similar to the tape dispenser 100 (FIG. 1) except that the tape dispenser 300 is smaller to fit on a narrower roll of tape. The tape dispenser 300 includes a first arm 302, a second arm 304, a holder 306, a roller 308, a retaining device 310, a blade 312 and one or more guides 314. In some embodiments, one or more springs 120 (FIG. 2) are included, and in some embodiments, hidden, within the roller 308 and/or the first arm 302 and the second arm 304. The spring(s) 120 are able to be any type of spring such as coiled torsion springs.

In some embodiments, an end of each of the first arm 302 and the second arm 304 is coupled to opposing ends of the roller 308. In some embodiments, the roller 308 is coupled to either the first arm 302 or the second arm 304. In some embodiments, the opposite end of the first arm 302 and the second arm 304 is coupled to opposing sides of the retaining device 310. In some embodiments, the retaining device 310 is coupled to the first arm 302 or the second arm 304. The retaining device 310 includes one or more guides 314 at one end. The blade 312 is coupled to or extends from the retaining device 310. In some embodiments, the blade 312 is coupled to or extends from the end opposite the guide(s) 314, and in some embodiments, the blade 312 is coupled to or extends from the same end of the guide(s) 314. A holder 306 such as a holder protrusion, pin or prong extends out or is coupled to the either the first arm 302 or the second arm 304, whichever does not have the retaining device 310.

Figure 4:
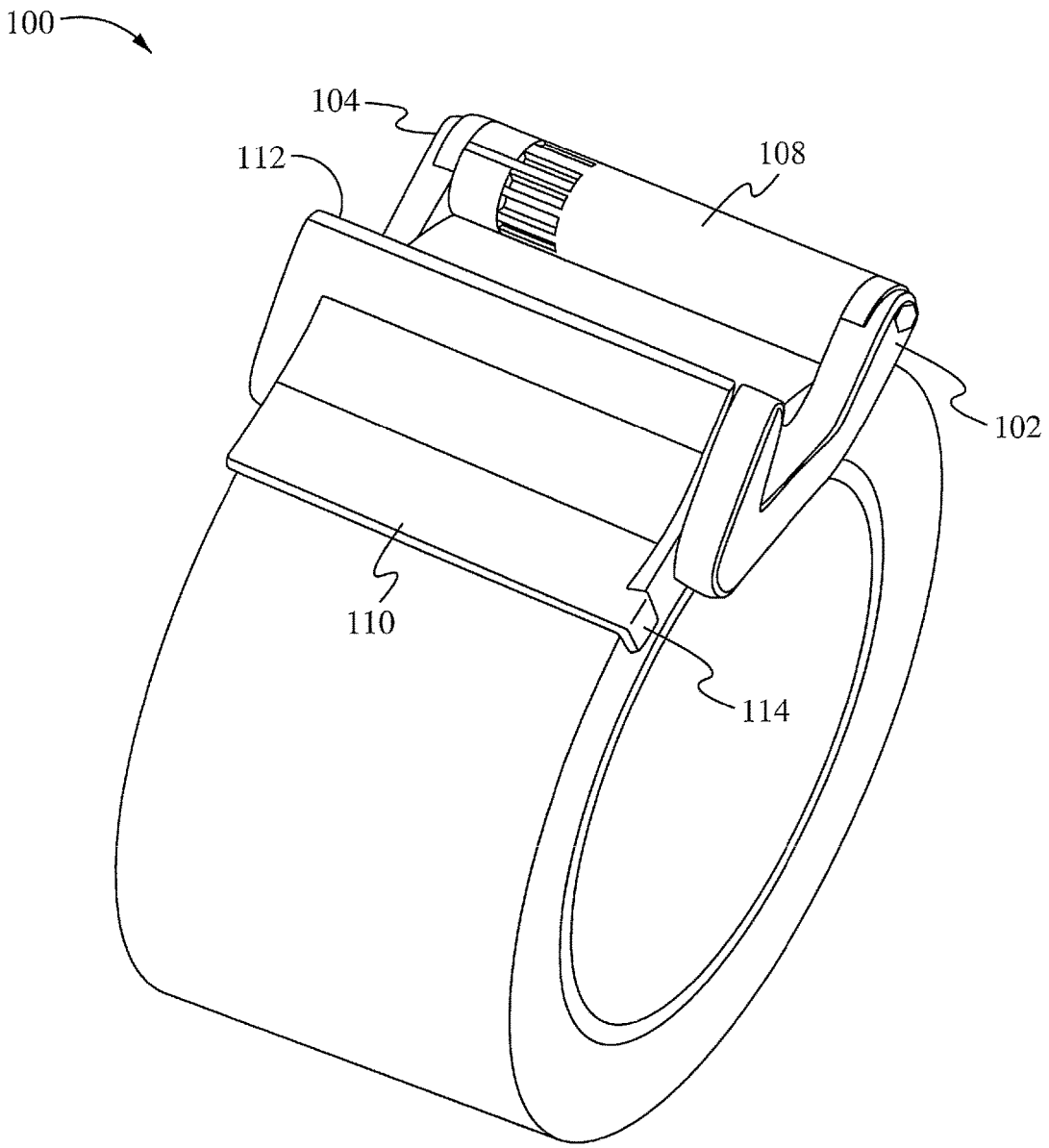
FIG. 4 illustrates a perspective view of a tape dispenser on a tape roll according to some embodiments.

FIG. 4 illustrates a perspective view of a tape dispenser 100 on a tape roll according to some embodiments. As described above, the tape dispenser 100 is secured to the tape roll with the holder 106 fitting on the inside of the roll and applying a force outward from the center of the roll. The roller 108 fits on the outside of the roll and applies a force inward. Further, the first arm 102 and the second arm 104 fit on the sides of the tape roll. The retaining device 110 rests on the tape surface. The guide(s) 114 ensure the retaining device 110 remains on the tape surface.

Figure 5:
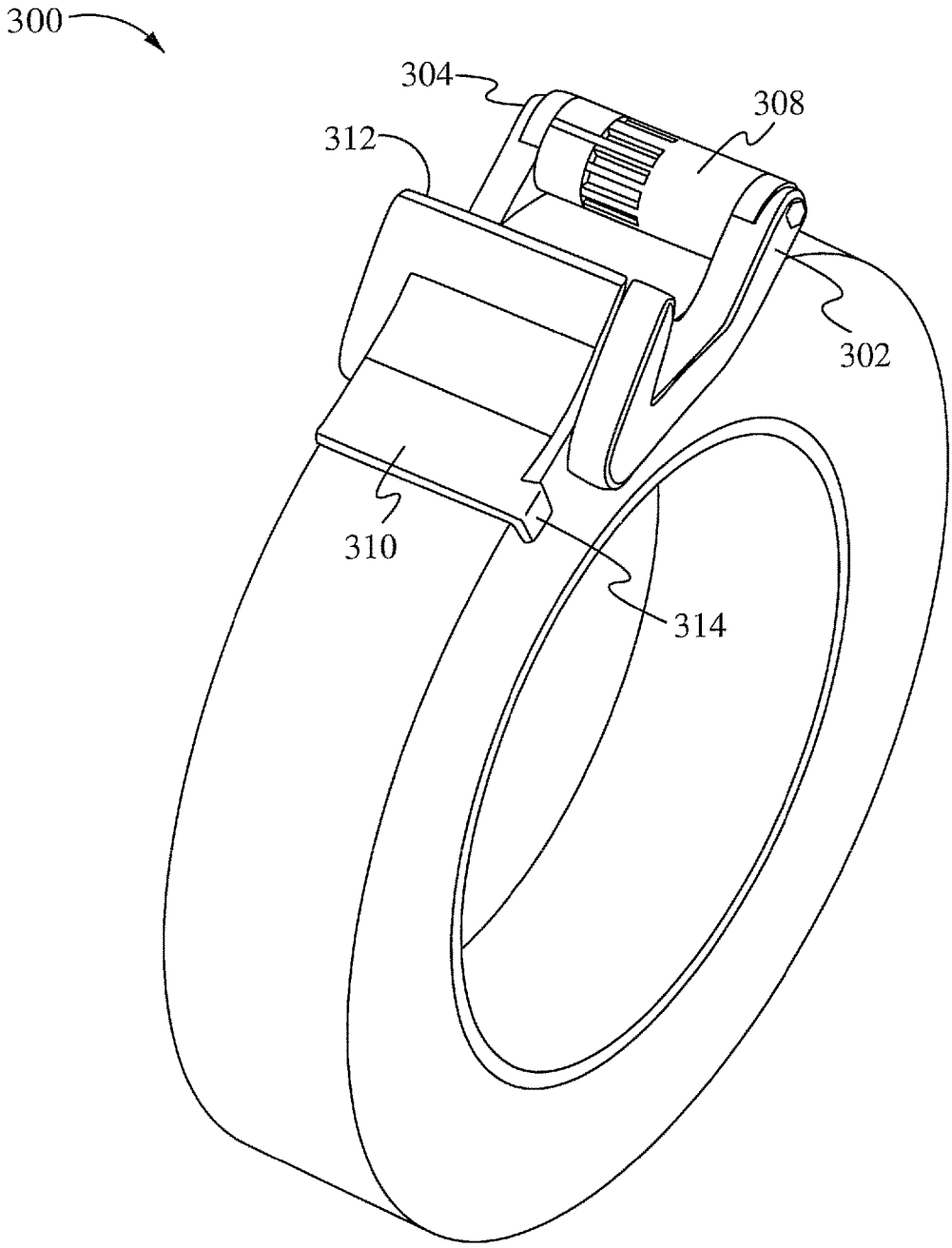
FIG. 5 illustrates a perspective view of a tape dispenser on a tape roll according to some embodiments.

FIG. 5 illustrates a perspective view of a tape dispenser 300 on a tape roll according to some embodiments. As described above, the tape dispenser 300 is secured to the tape roll with the holder 306 fitting on the inside of the roll and applying a force outward. The roller 308 fits on the outside of the roll and applies a force inward. Further, the first arm 302 and the second arm 304 fit on the sides of the tape roll. The retaining device 310 rests on the tape surface. The guide(s) 314 ensure the retaining device 310 remains on the tape surface.

Figure 6:
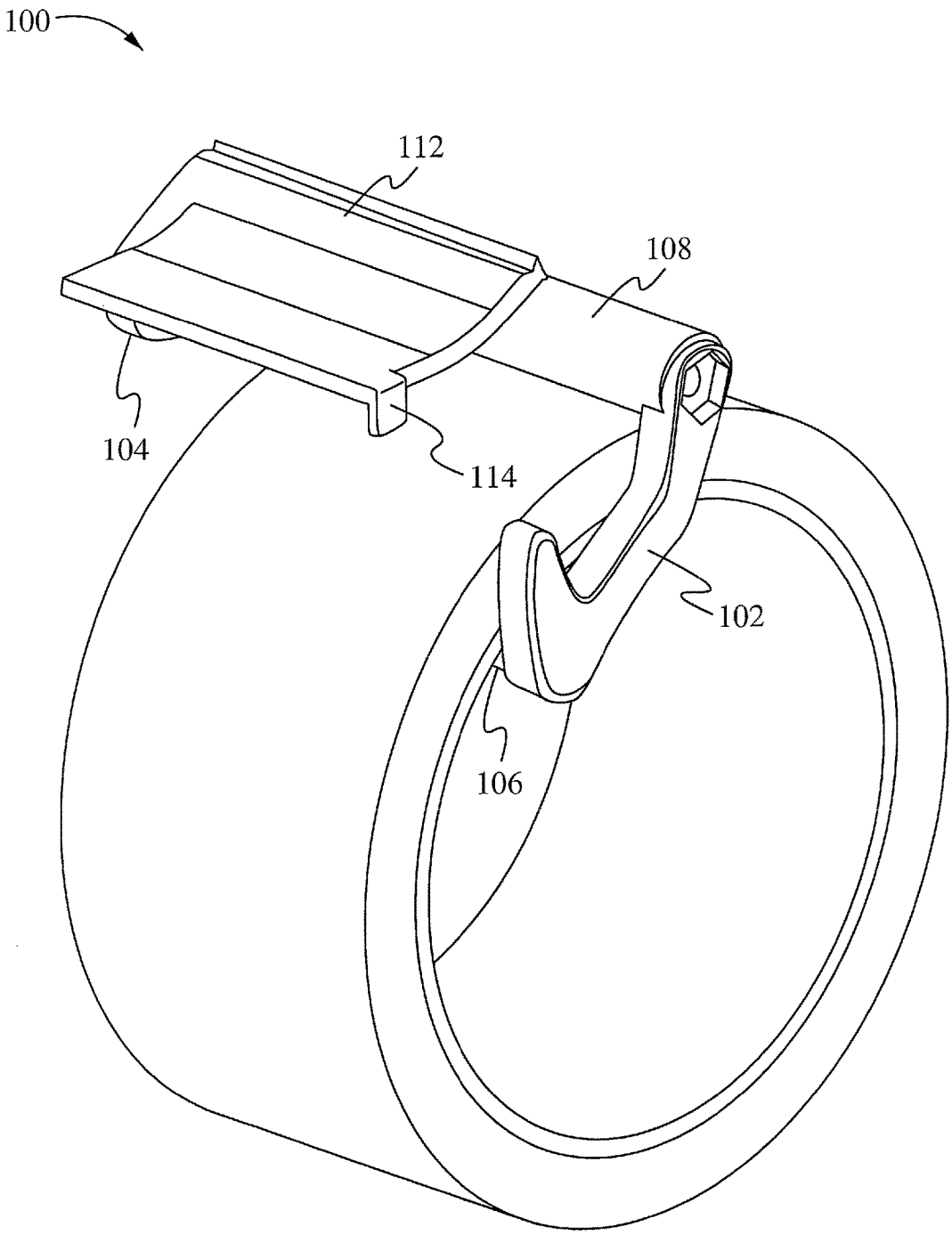
FIG. 6 illustrates a perspective view of a tape dispenser on a tape roll according to some embodiments.

FIG. 6 illustrates a perspective view of a tape dispenser 100 on a tape roll with the retaining device 110 in an open configuration according to some embodiments. In some embodiments, the retaining device 110 is put in the open configuration by lifting the arm that the retaining device is coupled to, such as the second arm 104.

Figure 7:
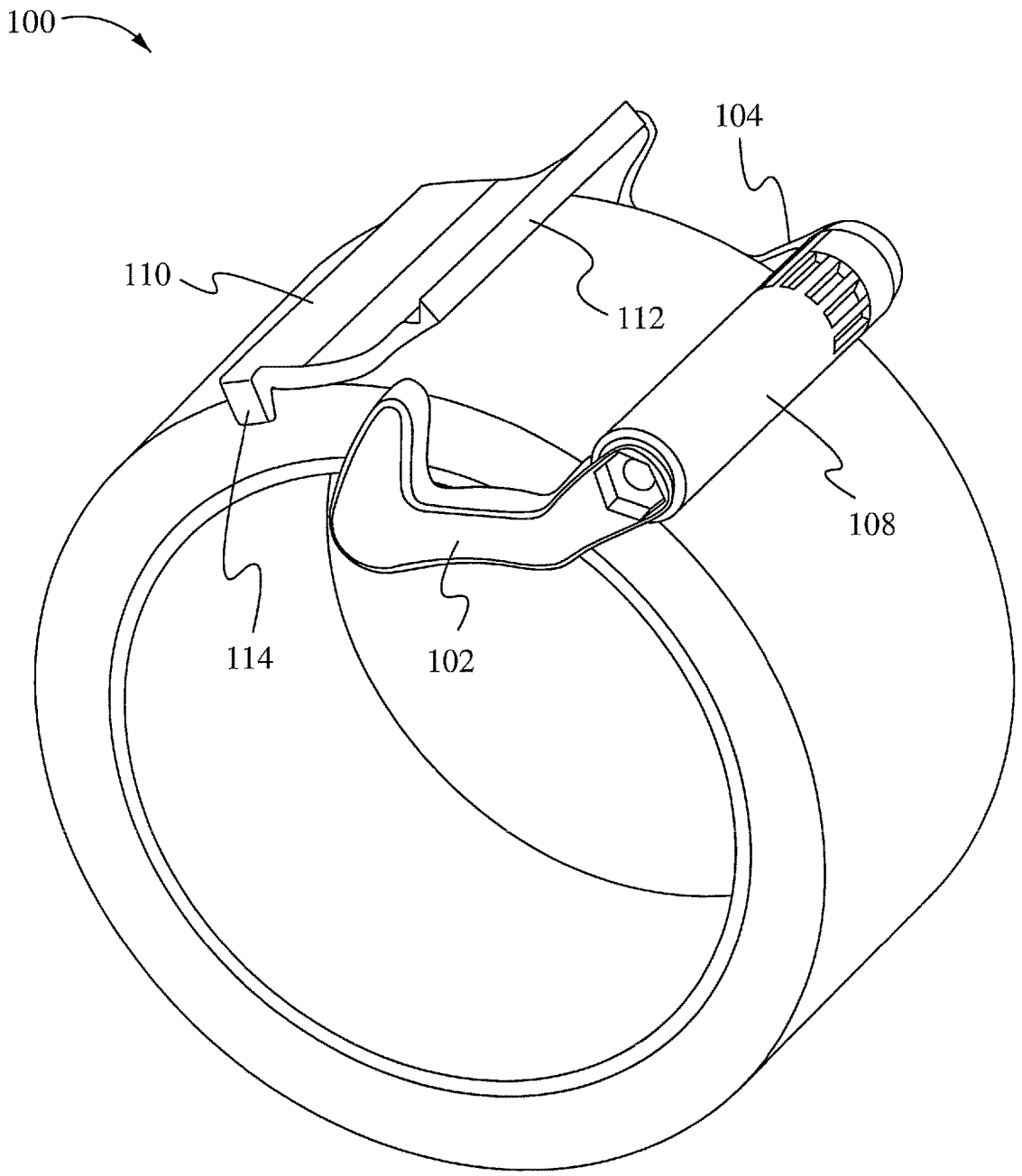
FIG. 7 illustrates a perspective view of a tape dispenser on a tape roll according to some embodiments.

FIG. 7 illustrates a perspective view of a tape dispenser 100 on a tape roll with the retaining device 110 in a closed configuration according to some embodiments. As described above, the tape dispenser 100 is secured to the tape roll with the holder 106 (FIG. 1) fitting on the inside of the roll and applying a force outward from the center of the roll. The roller 108 fits on the outside of the roll and applies a force inward. Further, the first arm 102 and the second arm 104 fit on the sides of the tape roll. The retaining device 110 rests on the tape surface. The guide(s) 114 ensure the retaining device 110 remains on the tape surface.

Figure 8:
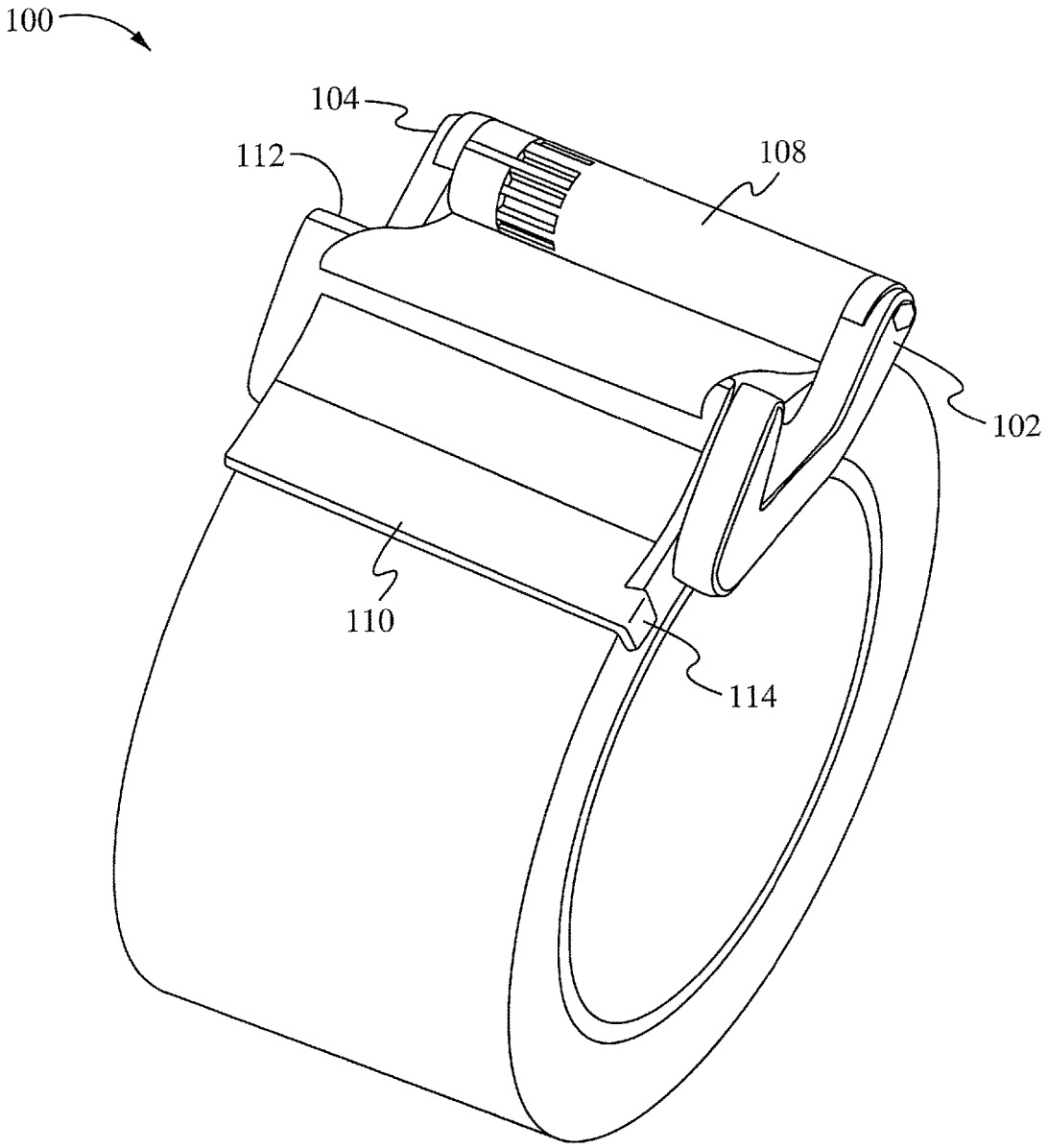
FIG. 8 illustrates a perspective view of a tape dispenser on a tape roll according to some embodiments.

FIG. 8 illustrates a perspective view of a tape dispenser 100 on a tape roll with a portion of the tape remaining on the retaining device 110 according to some embodiments. After a user tears a piece of tape from the tape roll, the remaining tape is retained on the retaining device 110. As tape is removed from the tape roll and the tape roll gets smaller, the holder 106 (FIG. 1) and the roller 108 continuously apply a force to the tape roll, which keeps the tape dispenser 100 in place and allows it to function.

Figure 9:
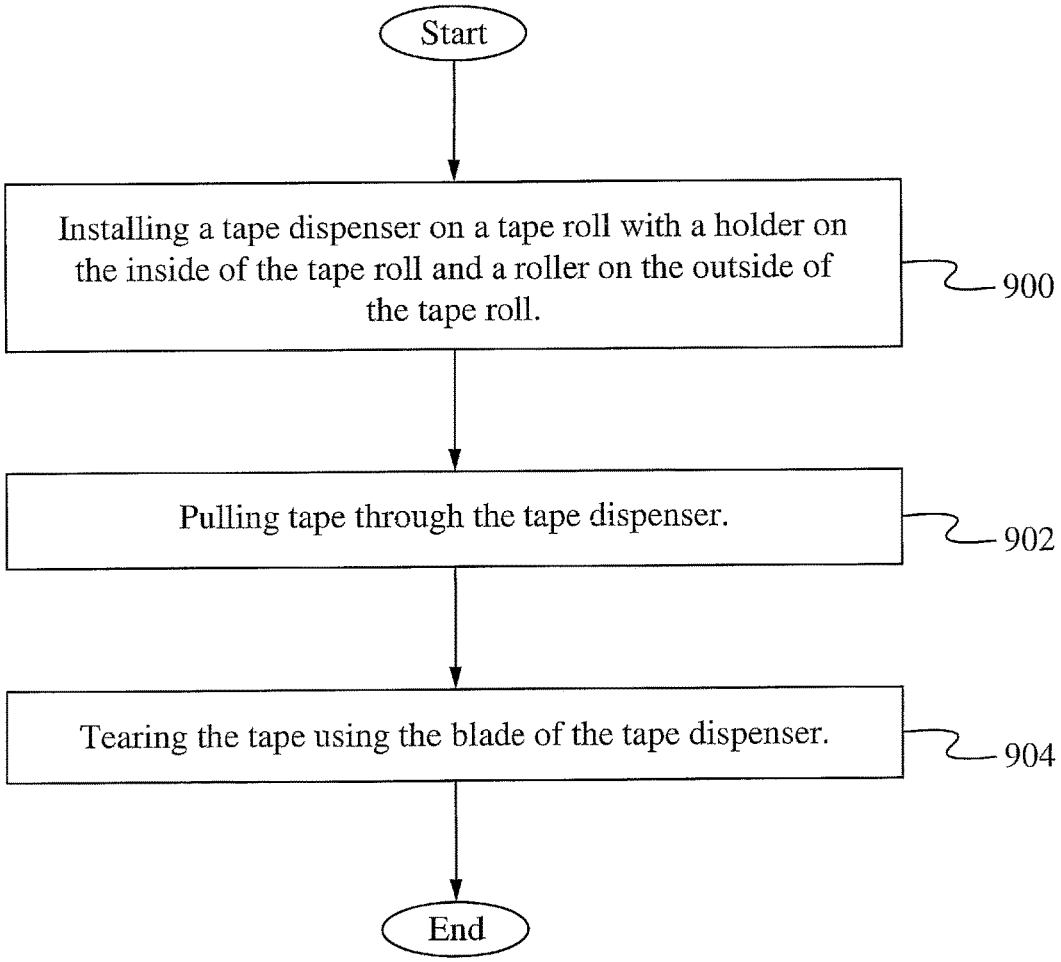
FIG. 9 illustrates a flowchart of a method of utilizing a tape dispenser according to some embodiments.

FIG. 9 illustrates a flowchart of a method of utilizing a tape dispenser according to some embodiments. In the step 900, a tape dispenser is installed on a tape roll with a holder positioned on the inside of the tape roll and a roller positioned on the outside of the tape roll. Additionally, the retaining device is positioned on the outside of the tape roll as well. The retaining device is maintained in position with the guide(s). In the step 902, tape is pulled through the tape dispenser. Specifically, the tape is pulled between the roller and the retaining device. The roller is able to roll the tape dispenser around the tape roll as the user pulls out more tape. In the step 904, the user tears the tape using the blade of the tape dispenser. The pulled-out tape that is still part of the tape roll remains on the retaining device so that the next time the user desires tape, he/she will not have to pick it off of the roll. The user is able to remove the tape dispenser by performing similar but opposite actions as were used to install the tape dispenser on the tape roll. In some embodiments, the arms and the retaining device are lifted up and away from (such as off a side of) the tape roll and then the tape dispenser is slid off to the side. The tape dispenser is able to be reused over and over again on other tape rolls.

The tape dispenser is able to be used with any kind of tape including, but not limited to, masking tape, duct tape, scotch™ tape, packing tape, silicone tape, electrical and vinyl tapes, reinforcing (Fiber) tape, protection tape, security tape, foam tape, urethane tape, marking tape and double sided tape. The tape dispenser is able to be used with other types of material beyond tape as well.

The components of the tape dispenser are able to be composed of any material including, but not limited to, metal, plastic, polymers, rubber or any combination thereof. The tape dispenser is able to be any size. In some embodiments, the tape dispenser is sized according to the tape roll, so that the tape dispenser fits securely on the tape roll.

In some embodiments, the blade is a separate blade that is coupled to the retaining device. In some embodiments, the retaining device is configured to have a blade or blade-like edge.

To utilize the tape dispenser, the tape dispenser is installed on a tape roll by positioning the holder of the tape dispenser on the inside of the tape roll and the roller and the retaining device on the outside of the tape roll. After the tape dispenser is installed on the tape roll, tape is pulled through the tape dispenser. When a desired length of tape is pulled out, the tape is torn using the blade of the tape dispenser. The pulled-out tape of the remaining tape roll stays on the retaining device of the tape dispenser for easy access the next time.

In operation, the tape dispenser provides a much smaller in size alternative to the large, bulky tape dispensers currently available. The tape dispenser fits on the tape roll using a holder and a roller. The tape dispenser is able to roll around the tape roll while maintaining a secure fit on the tape roll. The tape dispenser allows a user to easily retrieve tape by securing the end of the tape roll on the retaining device. The tape dispenser is also easily installable and removable so that switching between tape rolls is convenient.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device and method of the present invention could be implemented in several different ways and have several different appearances.

We claim:

1. A tape dispensing device comprising:

a. a first element;

b. a second element;

c. a roller coupled between the first element and the second element, to apply a force against a tape roll, the roller positioned on an outside of the tape roll;

d. a holder prong protruding from one of the first element and the second element the holder prong positioned on an inside of the tape roll;

e. a retaining area connected on one side to an opposite element of the first element and the second element of the holder prong;

f. a cutting device on the retaining area, the cutting device configured for cutting tape off the tape roll; and g. a discrete spring positioned within the roller and configured for biasing the roller against the tape roll.

2. The device of claim 1 wherein the roller is configured to roll or ride along the tape roll.

3. The device of claim 1 wherein the cutting device is coupled to the retaining area.

4. The device of claim 1 wherein the tape is selected from the group consisting of masking tape, duct tape, scotch tape, packing tape, silicone tape, electrical tape, reinforcing tape, protection tape, marking tape and double sided tape.

5. The device of claim 1 wherein the device comprises metal, plastic, polymers, rubber or any combination thereof.

6. A tape dispensing device comprising:

a. a first element;

b. a second element;

c. a roller coupled between the first element and the second element, the roller positioned on an outside of a tape roll;

d. a holder prong protruding from one of the first element and the second element, the holder prong positioned on an inside of the tape roll;

e. a retaining area connected on one side to an opposite element of the first element and the second element of the holder prong;

f. a cutting device on the retaining area, the cutting device configured for cutting tape off the tape roll; and g. a discrete spring positioned within the roller, the spring biasing the roller against the tape roll.

7. The device of claim 6 wherein the roller is configured to roll or ride along the tape roll.

8. The device of claim 6 wherein the cutting device is coupled to the retaining area.

9. The device of claim 6 wherein the tape is selected from the group consisting of masking tape, duct tape, scotch tape, packing tape, silicone tape, electrical tape, reinforcing tape, protection tape, marking tape and double sided tape.

10. The device of claim 6 wherein the device comprises metal, plastic, polymers, rubber or any combination thereof.

11. A method of utilizing a tape dispenser comprising:

a. positioning a holder prong on an inside of a tape roll and positioning a roller on an outside of the tape roll, wherein the tape dispenser further comprises a discrete spring positioned within the roller for biasing the roller against the tape roll;

b. pulling tape through the tape dispenser; and c. tearing the tape using a cutting device of the tape dispenser.

12. The method of claim 11 wherein the tape dispenser is pulled through the holder prong and the roller.

13. The method of claim 11 further comprising removing the tape dispenser from the tape roll.

14. The method of claim 13 wherein removing the tape dispenser from the tape roll includes lifting either a first element or a second element, and a retaining device are lifted up and away from the tape roll.

15. The method of claim 11 wherein the roller is configured to roll while the tape is pulled from the tape dispenser.

16. The method of claim 11 wherein the tape remains on a retaining area after tearing the tape.

17. The method of claim 16 wherein the cutting device is coupled to the retaining area.

18. The method of claim 11 wherein the tape is selected from the group consisting of masking tape, duct tape, scotch tape, packing tape, silicone tape, electrical tape, reinforcing tape, protection tape, marking tape and double sided tape.

19. The method of claim 11 wherein the tape dispenser comprises metal, plastic, polymers, rubber or any combination thereof.

20. A tape dispensing device comprising:

a. a first element;

b. a second element;

c. a holder protruding from one of the first element and the second element, the holder positioned on an inside of the tape roll;

d. a roller coupled between the first element and the second element to apply a force against an outside of a tape roll; and e. a discrete spring positioned within the roller for biasing the roller against the tape roll.

21. The device of claim 20 wherein the roller is configured to roll or ride along the tape roll.

22. The device of claim 20 wherein the tape is selected from the group consisting of masking tape, duct tape, scotch tape, packing tape, silicone tape, electrical tape, reinforcing tape, protection tape, marking tape and double sided tape.

* * * * *